US012298013B2

(12) United States Patent
Johnson

(10) Patent No.: US 12,298,013 B2
(45) Date of Patent: May 13, 2025

(54) OVEN APPLIANCE AND METHODS OF STATE-CONTINGENT OPERATION

(71) Applicant: Haier US Appliance Solutions, Inc., Wilmington, DE (US)

(72) Inventor: Eric Scott Johnson, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 715 days.

(21) Appl. No.: 17/519,034

(22) Filed: Nov. 4, 2021

(65) Prior Publication Data

US 2023/0137454 A1 May 4, 2023

(51) Int. Cl.
*F24C 7/08* (2006.01)

(52) U.S. Cl.
CPC ..... *F24C 7/088* (2013.01)

(58) Field of Classification Search
CPC ..... F24C 7/085; F24C 7/087; F24C 7/088
See application file for complete search history.

(56) References Cited

U.S. PATENT DOCUMENTS

| | | | | |
|---|---|---|---|---|
| 3,358,122 | A | 12/1967 | Torrey | |
| 4,865,010 | A | 9/1989 | Kett | |
| 5,695,668 | A | 12/1997 | Boddy | |
| 6,758,206 | B1 | 7/2004 | Barnes | |
| 6,943,321 | B2 | 9/2005 | Brekken | |
| 6,987,252 | B2 | 1/2006 | Goodrich | |
| 7,378,617 | B1 | 5/2008 | Brockman | |
| 8,049,142 | B2 | 11/2011 | Blackson | |
| 9,927,127 | B2 * | 3/2018 | Johnson | F24C 7/085 |
| 9,930,897 | B2 | 4/2018 | Blue et al. | |
| 9,995,492 | B2 | 6/2018 | Adelmann | |
| 10,012,392 | B2 | 7/2018 | Froelicher et al. | |
| 10,082,297 | B2 | 9/2018 | Kim | |
| 10,314,433 | B1 | 6/2019 | Knight | |
| 10,448,457 | B2 | 10/2019 | Armstrong | |

(Continued)

FOREIGN PATENT DOCUMENTS

| | | |
|---|---|---|
| CN | 204795645 U | 11/2015 |
| EP | 0579917 A2 | 1/1994 |

(Continued)

*Primary Examiner* — Dana Ross
*Assistant Examiner* — Joe E Mills, Jr.
(74) *Attorney, Agent, or Firm* — Dority & Manning, P.A.

(57) ABSTRACT

An oven appliance may include a cabinet, a plurality of chamber walls, a cooking surface, a heating element, and a controller. The plurality of chamber walls may be mounted within the cabinet. The plurality of chamber walls may define an oven chamber. The cooking surface may be defined in the oven chamber. The heating element may be mounted in thermal communication with the oven chamber to heat the cooking surface. The controller may be in operative communication with the heating element. The controller may be configured to initiate a cooking operation that includes determining a cooking stability state within the oven chamber, directing a preheating cycle within the oven chamber following determining the cooking stability state, selecting a parameter value according to the cooking stability state, and directing activation of the heating element in a cooking cycle according to the selected parameter value following the preheating cycle.

18 Claims, 7 Drawing Sheets

(56) References Cited

U.S. PATENT DOCUMENTS

| | | | | |
|---|---|---|---|---|
| 10,502,430 | B1 | 12/2019 | Alvey | |
| 10,520,199 | B2 | 12/2019 | Polster | |
| 2004/0149722 | A1 | 8/2004 | Schnell et al. | |
| 2014/0360387 | A1 | 12/2014 | Bogdon | |
| 2015/0208669 | A1 | 7/2015 | Cavalcanti | |
| 2017/0089590 | A1 | 3/2017 | Bruin-Slot et al. | |
| 2017/0130968 | A1 | 5/2017 | Nagraj | |
| 2018/0003390 | A1 | 1/2018 | Trice et al. | |
| 2021/0404745 | A1* | 12/2021 | Johnson | A21B 1/40 |

FOREIGN PATENT DOCUMENTS

| | | | |
|---|---|---|---|
| EP | 2251609 | B1 | 8/2017 |
| JP | H07280281 | A | 10/1995 |
| JP | 2010112664 | A | 5/2010 |

* cited by examiner

OVEN APPLIANCE AND METHODS OF STATE-CONTINGENT OPERATION

FIELD OF THE INVENTION

The present subject matter relates generally to oven appliances, and more particularly, to methods of operating an oven appliance for state-contingent cooking.

BACKGROUND OF THE INVENTION

Conventional residential and commercial oven appliances generally include a cabinet that includes a cooking chamber for receipt of food items for cooking. Multiple gas or electric heating elements are positioned within the cabinet for heating the cooking chamber to cook food items located therein. The heating elements can include, for example, a bake heating assembly positioned at a bottom of the cooking chamber and a separate broiler heating assembly positioned at a top of the cooking chamber.

Typically, food or utensils for cooking are placed on wire racks within the cooking chamber and above the bake heating assembly. In some instances, protective or radiant plates are positioned over the bake heating assembly to protect the bake heating assembly or assist in evenly distributing heat across the bottom of the cooking chamber. Nonetheless, certain food items, such as pizzas or breads, may benefit from very high, localized (i.e., non-diffuse) heat, or a cooking utensil with a relatively high thermal mass may be used. This may be case when using a stone or specialized high-heat pan (e.g., to trap heat against the bottom of flat-breads or pizza) or a cast iron skillet.

Difficulties may arise in executing localized, high-heat operations, or with using cooking utensils that are heavy or otherwise have a high thermal mass. In particular, it may be difficult to consistently or appropriately heat the cooking chamber or cooking utensils therein. The wide variation for temperatures within an oven appliance (e.g., prior to preheating the oven appliance) may make it especially difficult to achieve consistent temperatures following a preheating cycle. Additionally or alternatively, problems with consistency or accuracy within an oven appliance may be exacerbated by cooking multiple items in relatively quick succession. For instance, if a user attempts to cook multiple items, one right after the other, trapped heat may cause the later-cooked items to reach certain internal temperatures faster or at a different rate than the earlier-cooked items. This can result in inconsistent or unsuitable (e.g., burned) food items. As a result, typical cooking appliances require all heating elements to completely deactivate while the cooking chamber is allowed to cool significantly (e.g., to within 100° Fahrenheit of the ambient temperature).

Accordingly, it would be advantageous to provide an oven appliance or methods for consistently or accurately heating an oven appliance (e.g., regardless of the temperature within the cooking chamber prior to preheating). Additionally or alternatively, it would be advantageous to provide an oven appliance or methods for consistently cooking separate items at a high heat and in quick succession (e.g., without requiring the oven to completely deactivate or return to a temperature near the ambient temperature).

BRIEF DESCRIPTION OF THE INVENTION

Aspects and advantages of the invention will be set forth in part in the following description, or may be obvious from the description, or may be learned through practice of the invention.

In one exemplary aspect of the present disclosure, an oven appliance is provided. The oven appliance may include a cabinet, a plurality of chamber walls, a cooking surface, a heating element, and a controller. The plurality of chamber walls may be mounted within the cabinet. The plurality of chamber walls may define an oven chamber. The cooking surface may be defined in the oven chamber. The heating element may be mounted in thermal communication with the oven chamber to heat the cooking surface. The controller may be in operative communication with the heating element. The controller may be configured to initiate a cooking operation that includes determining a cooking stability state within the oven chamber, directing a preheating cycle within the oven chamber following determining the cooking stability state, selecting a parameter value according to the cooking stability state, and directing activation of the heating element in a cooking cycle according to the selected parameter value following the preheating cycle.

In another exemplary aspect of the present disclosure, a method of operating an oven appliance is provided. The method may include determining a cooking stability state within an oven chamber. The method may further include directing a preheating cycle within the oven chamber following determining the cooking stability state. The method may still further include selecting a parameter value according to the cooking stability state and directing activation of the heating element in a cooking cycle according to the selected parameter value following the preheating cycle.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
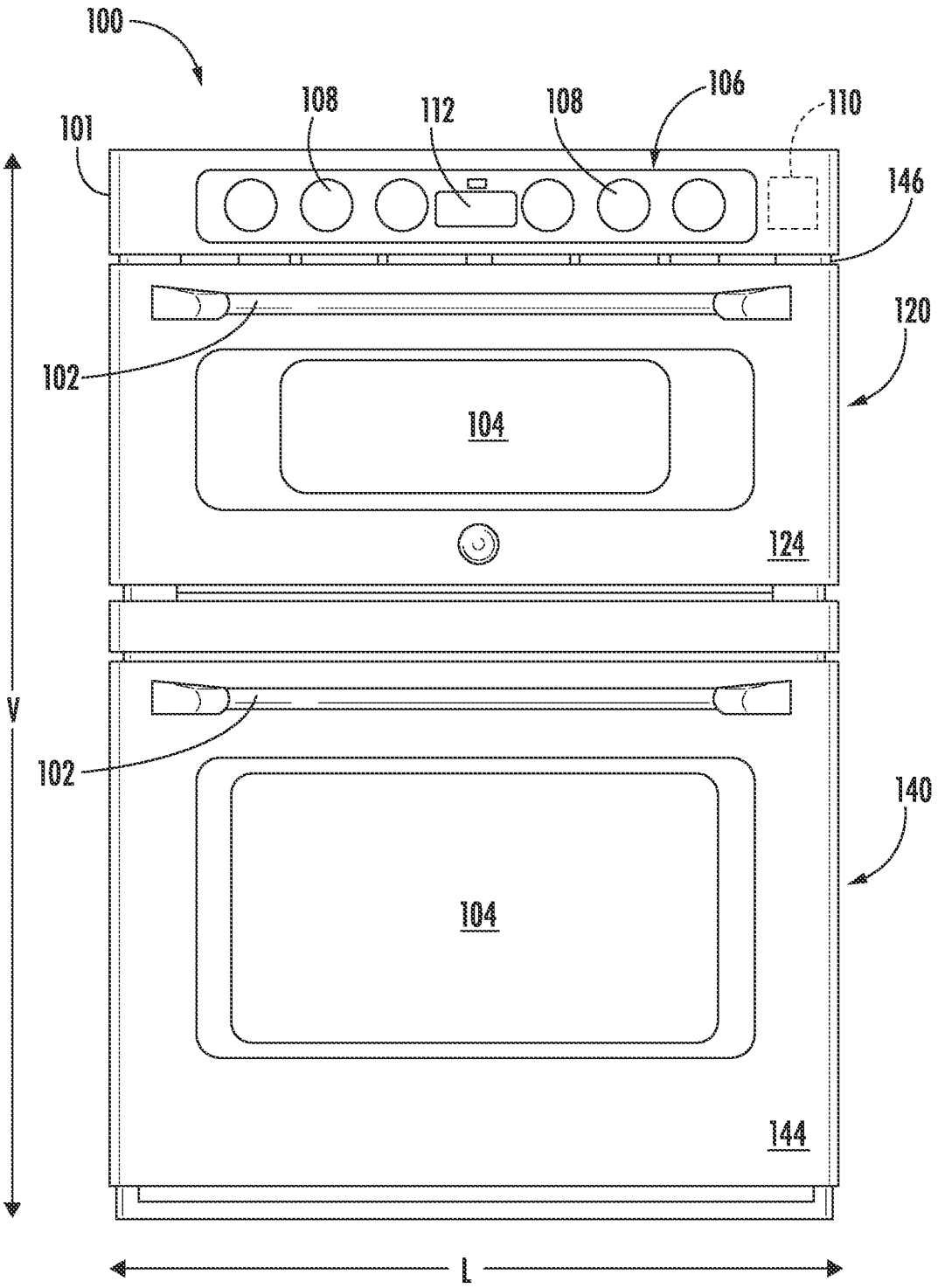
FIG. 1 provides an elevation view of an oven appliance according to exemplary embodiments of the present disclosure.
Figure 2:
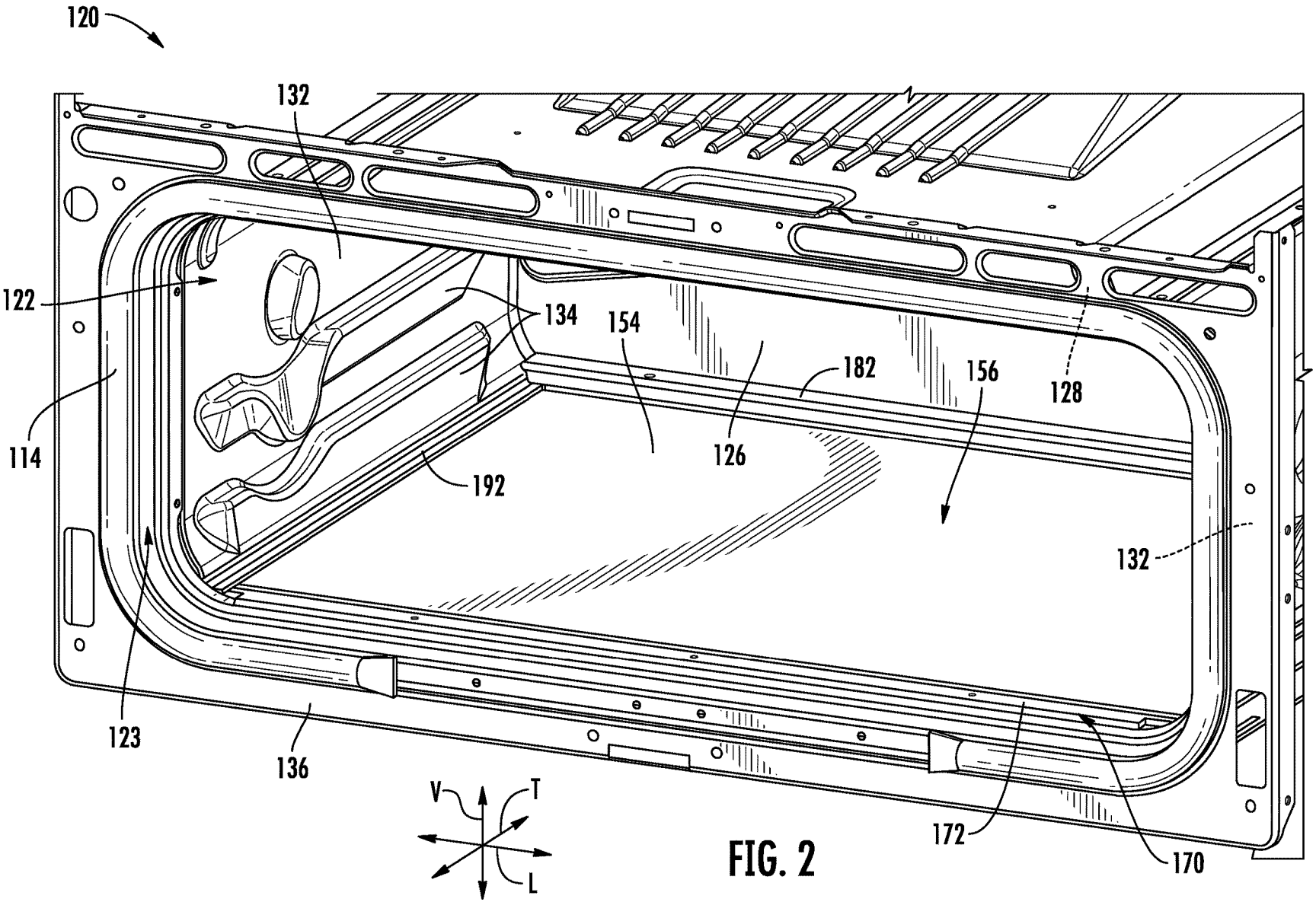
FIG. 2 provides a perspective view of an upper cooking chamber of the exemplary oven appliance of FIG. 1.
Figure 3:
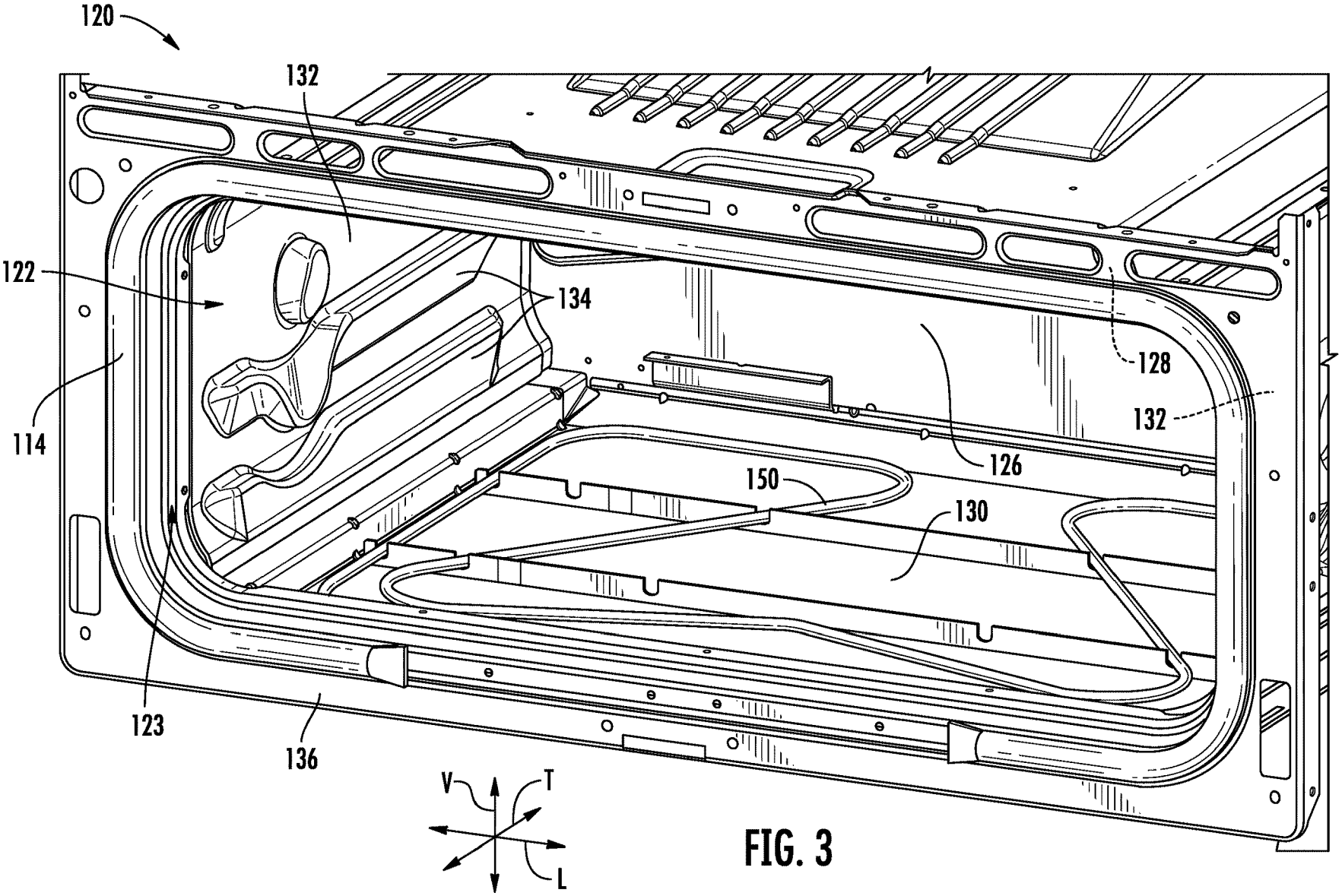
FIG. 3 provides another perspective view of the upper cooking chamber of the exemplary oven appliance of FIG. 1, wherein a cooking plate has been omitted for clarity.
Figure 4:
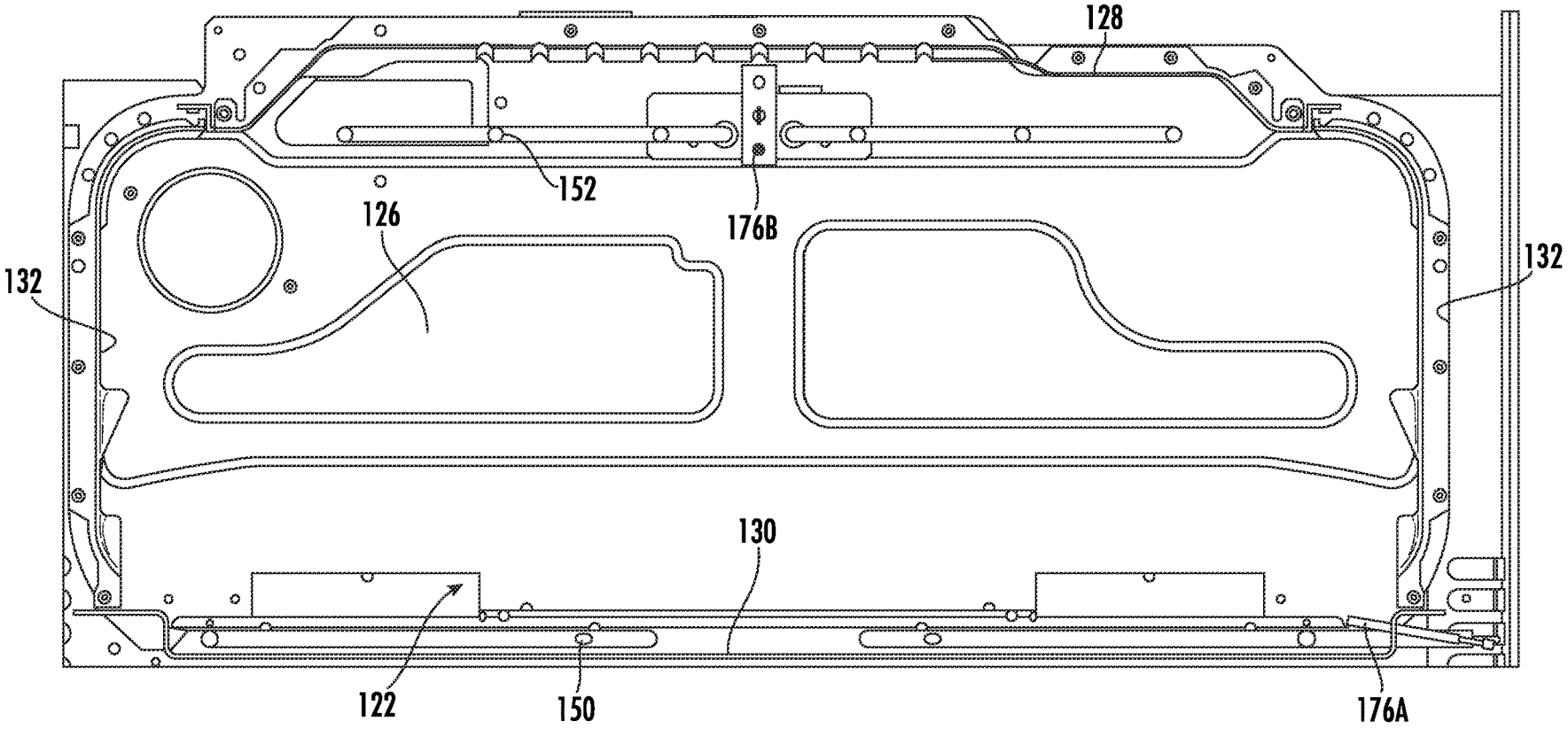
FIG. 4 provides an elevation view of the exemplary upper cooking chamber of FIG. 3.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "or" is generally intended to be inclusive (i.e., "A or B" is intended to mean "A or B or both"). The terms "first," "second," and "third" may be used interchangeably to distinguish one component from another and are not intended to signify location or importance of the individual components. The terms "upstream" and "downstream" refer to the relative flow direction with respect to fluid flow in a fluid pathway. For example, "upstream" refers to the flow direction from which the fluid flows, and "downstream" refers to the flow direction to which the fluid flows. The terms "coupled," "fixed," "attached to," and the like refer to both direct coupling, fixing, or attaching, as well as indirect coupling, fixing, or attaching through one or more intermediate components or features, unless otherwise specified herein.

Referring now to the drawings, FIG. 1 illustrates an exemplary embodiment of a double oven appliance 100 according to the present disclosure.

Although aspects of the present subject matter are described herein in the context of a double oven appliance 100, it should be appreciated that oven appliance 100 is provided by way of example only. Other oven or range appliances having different configurations, different appearances, or different features may also be utilized with the present subject matter as well (e.g., single ovens, electric cooktop ovens, induction cooktops ovens, etc.).

Generally, oven appliance 100 has a cabinet 101 that defines a vertical direction V, a longitudinal direction L and a transverse direction T. The vertical, longitudinal and transverse directions are mutually perpendicular and form an orthogonal direction system. In this regard, as used herein, the terms "cabinet," "housing," and the like are generally intended to refer to an outer frame or support structure for appliance 100, e.g., including any suitable number, type, and configuration of support structures formed from any suitable materials, such as a system of elongated support members, a plurality of interconnected panels, or some combination thereof. It should be appreciated that cabinet 101 does not necessarily require an enclosure and may simply include open structure supporting various elements of appliance 100. By contrast, cabinet 101 may enclose some or all portions of an interior of cabinet 101. It should be appreciated that cabinet 101 may have any suitable size, shape, and configuration while remaining within the scope of the present subject matter.

Double oven appliance 100 includes an upper oven 120 and a lower oven 140 positioned below upper oven 120 along the vertical direction V. Upper and lower ovens 120 and 140 include oven or cooking chambers 122 and 142, respectively, configured for the receipt of one or more food items to be cooked. Specifically, cabinet 101 defines a respective opening 123 for each cooking chamber 122 and 142. For instance, an upper opening 123 may be defined (e.g., along the transverse direction T) to access upper cooking chamber 122.

Double oven appliance 100 includes an upper door 124 and a lower door 144 in order to permit selective access to cooking chambers 122 and 142, respectively (e.g., via the corresponding opening). Handles 102 are mounted to upper and lower doors 124 and 144 to assist a user with opening and closing doors 124 and 144 in order to access cooking chambers 122 and 142. As an example, a user can pull on handle 102 mounted to upper door 124 to open or close upper door 124 and access cooking chamber 122. Glass window panes 104 provide for viewing the contents of cooking chambers 122 and 142 when doors 124, 144 are closed and also assist with insulating cooking chambers 122 and 142. Optionally, a seal or gasket (e.g., gasket 114) extends between each door 124, 144 and cabinet 101 (e.g., when the corresponding door 124 or 144 is in the closed position). Such gasket may assist with maintaining heat and cooking fumes within the corresponding cooking chamber 122 or 142 when the door 124 or 144 is in the closed position. Moreover, heating elements, such as electric resistance heating elements, gas burners, microwave elements, etc., are positioned within upper and lower oven 120 and 140.

A control panel 106 of double oven appliance 100 provides selections for user manipulation of the operation of double oven appliance 100. For example, a user can touch control panel 106 to trigger one of user inputs 108. In response to user manipulation of user inputs 108, various components of the double oven appliance 100 can be operated. Control panel 106 may also include a display 112, such as a digital display, operable to display various parameters (e.g., temperature, time, cooking cycle, etc.) of the double oven appliance 100.

Figure 5:
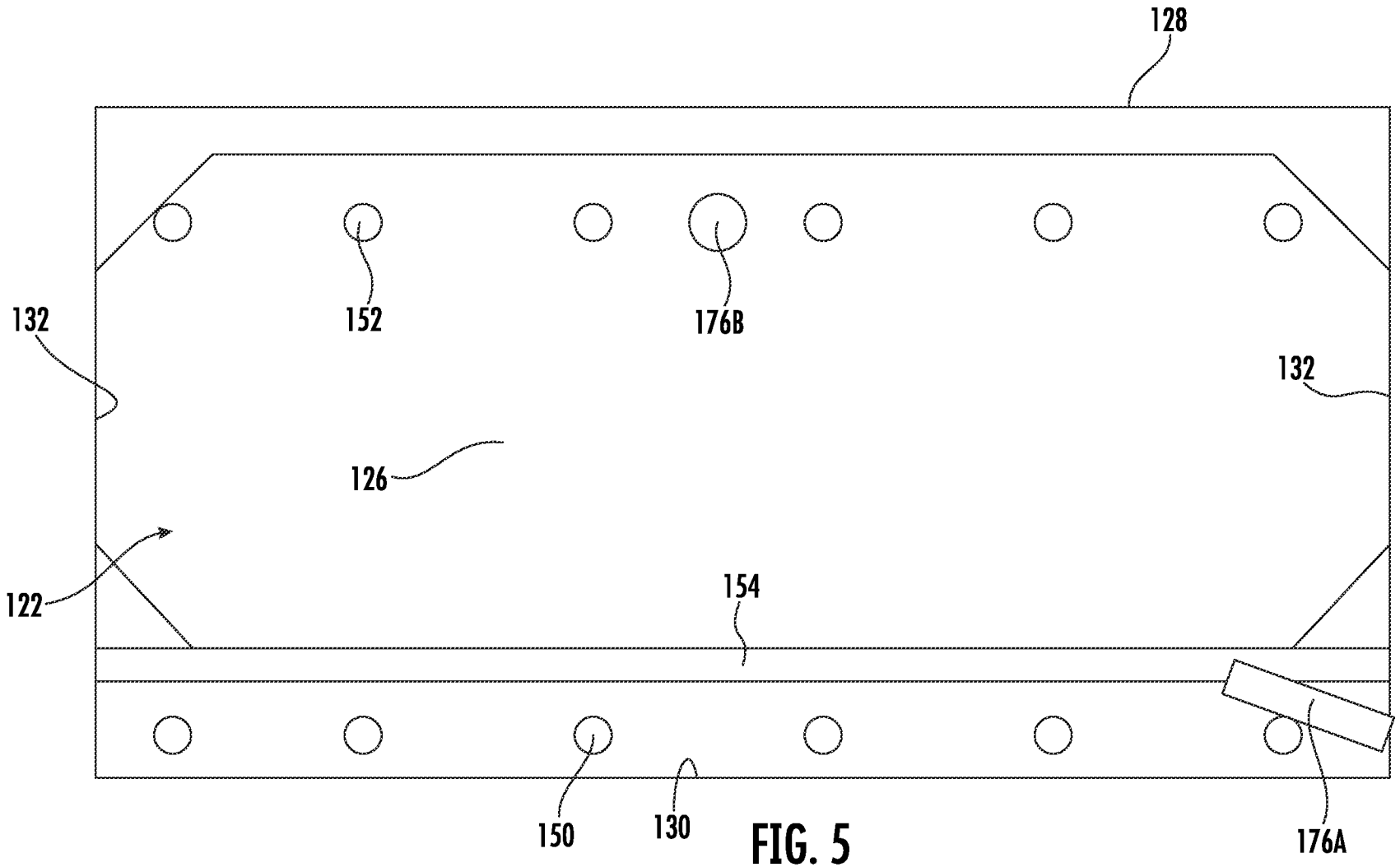
FIG. 5 provides a schematic elevation view of the upper cooking chamber of the exemplary oven appliance of FIG. 1.

Generally, oven appliance 100 may include a controller 110 in operative communication (e.g., operably coupled via a wired or wireless channel) with control panel 106. Control panel 106 of oven appliance 100 may be in communication with controller 110 via, for example, one or more signal lines or shared communication buses, and signals generated in controller 110 operate oven appliance 100 in response to user input via user input devices 108. Input/Output ("I/O") signals may be routed between controller 110 and various operational components of oven appliance 100 such that operation of oven appliance 100 can be regulated by controller 110. In addition, controller 110 may also be communication with one or more sensors, such as a first temperature sensor (TS1) 176A or a second temperature sensor (TS2) 176B (FIG. 5). Generally, either or both TS1 176A and TS2 176B may include or be provided as a thermistor or thermocouple, which may be used to measure temperature at a location proximate to upper cooking chamber 122 and provide such measurements to the controller 110. Although TS1 176A is illustrated as a probe extending proximate to or above bottom heating element 150 (e.g., to or below a cooking plate 154) and TS2 176B is illustrated proximate to or below top heating element 152 (e.g., above ribs 134 or cooking plate 154), it should be appreciated that other sensor types, positions, and configurations may be used according to alternative embodiments.

Controller 110 is a "processing device" or "controller" and may be embodied as described herein. Controller 110 may include a memory and one or more microprocessors, microcontrollers, application-specific integrated circuits (ASICS), CPUs or the like, such as general or special purpose microprocessors operable to execute programming instructions or micro-control code associated with operation of oven appliance 100, and controller 110 is not restricted necessarily to a single element. The memory may represent random access memory such as DRAM, or read only memory such as ROM, electrically erasable, programmable read only memory (EEPROM), or FLASH. In one embodiment, the processor executes programming instructions stored in memory. The memory may be a separate component from the processor or may be included onboard within the processor. Alternatively, controller 110 may be constructed without using a microprocessor (e.g., using a combination of discrete analog or digital logic circuitry; such as switches, amplifiers, integrators, comparators, flip-flops, AND gates, and the like) to perform control functionality instead of relying upon software.

Turning now to FIGS. 2 through 5, various views are provided illustrating, in particular, upper cooking chamber 122 of upper oven 120. As shown, upper cooking chamber 122 is generally defined by a back wall 126, a top wall 128 and a bottom wall 130 spaced from top wall 128 along the vertical direction V by opposing side walls 132 (e.g., a first wall and a second wall). Optionally, a front plate 136 may be attached to the walls to define the upper opening 123. For instance, front plate 136 may extend along bottom wall 130, top wall 128, and the opposing side walls 132 about upper opening 123. In turn, gasket 114 may be mounted on or engaged with front plate 136 (e.g., when the corresponding upper door is closed). In some embodiments opposing side walls 132 include embossed ribs 134 such that a baking rack containing food items may be slidably received onto embossed ribs 134 and may be moved into and out of upper cooking chamber 122 when door 124 is open. Optionally, such walls 126, 128, 130, 132 may be included within an outer casing 146 of cabinet 101, as is understood.

As shown, upper oven includes one or more heating elements to heat upper cooking chamber 122 (e.g., as directed by controller 110 as part of a cooking operation). For instance, a bottom heating element 150 may be mounted at a bottom portion of upper cooking chamber 122 (e.g., above bottom wall 130). Additionally or alternatively, a top heating element 152 may be mounted at a top portion of upper cooking chamber 122 (e.g., below top wall 128). Bottom heating element 150 and top heating element 152 may be used independently or simultaneously to heat upper cooking chamber 122, perform a baking or broil operation, perform a cleaning cycle, etc.

The heating elements 150, 152 may be provided as any suitable heater for generating heat within upper cooking chamber 122. For instance, either heating element may include an electric heating element (e.g., resistance wire elements, radiant heating element, electric tubular heater or CALROD®, halogen heating element, etc.). Additionally or alternatively, either heating element may include a gas burner.

In some embodiments, a cooking plate 154 is provided within upper cooking chamber 122. Specifically, cooking plate 154 is disposed above bottom heating element 150 and may generally cover the same. Along with being disposed above bottom heating element 150, cooking plate 154 is disposed below top heating element 152 and may be disposed below (e.g., at a lower vertical height than) each of the embossed ribs. In certain embodiments, cooking plate 154 is located at or near the same vertical height as the bottommost edge of upper opening 123. Thus, cooking plate 154 may generally be disposed proximal to the lower end of the cooking chamber 122.

When mounted within cooking chamber 122, cooking plate 154 may extend along the transverse direction T between a front end 160 and a rear end 162, along the lateral direction L between a first lateral end 164 and a second lateral end 166, and along the vertical direction V between an upper cooking surface 156 and a lower surface 158. The cooking surface 156, in particular, may be disposed between the bottom wall 130 and the top wall 128. Moreover, cooking surface 156 may be proximal to the bottom wall 130 and, thus, distal to the top wall 128. In some embodiments, cooking plate 154 is provided as a solid nonpermeable member. Thus, food or fluids may be prevented from passing through cooking plate 154 (e.g., along the vertical direction V or perpendicular to cooking surface 156). In certain embodiments, cooking plate 154 includes or is formed from a conductive metal material, such as cast iron, steel, or aluminum (e.g., including alloys thereof). In additional or alternative embodiments, cooking plate 154 includes or is formed from a heat-retaining material, such as clay, stone (e.g., cordierite), ceramic, cast iron, or ceramic-coated carbon steel.

As shown, the cooking plate 154 may be disposed directly above (e.g., in vertical alignment with) the bottom heating element 150. Moreover, cooking plate 154 may define a horizontal footprint that spans across horizontal footprint of bottom heating element 150. In turn, cooking plate 154 may fully cover bottom heating element 150. When mounted within cooking chamber 122, cooking plate 154 may block or otherwise prevent access to bottom heating element 150, such as by a user reaching into the cooking chamber 122. Additionally or alternatively, the bottom heating element 150 may be held out of view such that a user is unable to see the bottom heating element 150. During use, heat generated at bottom heating element 150 may be directed upward to a lower surface 158 of cooking plate 154. As noted, bottom heating element 150 may be vertically aligned with (e.g., directly beneath) the cooking plate 154. The heat generated at bottom heating element 150 may thus be guided primarily or initially to the underside of cooking plate 154.

One or more temperature sensors (e.g., TS1 176A) may be provided proximal to the bottom wall 130 (i.e., distal to top wall 128) in or otherwise within thermal communication with cooking chamber 122, for instance, to detect the temperature of bottom heating element 150 or cooking plate 154. Optionally, TS1 176A may be mounted or held between the bottom heating element 150 and the cooking plate 154. In some embodiments, a TS1 176A is disposed against (e.g., a bottom surface of) cooking plate 154. As an example, TS1 176A may be disposed on a bottom surface of cooking plate 154 (e.g., when cooking plate 154 is mounted within cooking chamber 122). As an additional or alternative example, TS1 176A may be held within a recess in cooking plate 154. As an additional or alternative example, TS1 176A may be embedded within cooking plate 154.

Additionally or alternatively, one or more temperature sensors (e.g., TS2 176B) may be provided proximal to the top wall 128 (i.e., distal to bottom wall 130) in or otherwise within thermal communication with cooking chamber 122, for instance, to detect the temperature of top heating element 152 or cooking chamber 122, generally. Optionally, TS2 176B may be mounted between the top wall 128 and the cooking plate 154 (e.g., above TS1 176A). In some embodiments, TS2 176B is mounted at or below heating element 152. Specifically, TS2 176B may be laterally positioned between the side walls 132 (e.g., at substantially the lateral middle of cooking chamber 122). As an example, TS2 176B may be connected to or otherwise supported on back wall 126 (e.g., via a mechanical fastener, clip, or hook).

When assembled, the temperature sensor(s) 176A, 176B may be operably coupled to controller 110. Moreover, the controller 110 may be configured to control top heating element 152 or bottom heating element 150 based on one or more temperatures detected at the temperature sensor(s)

176A, 176B (e.g., as part of a cooking operation). In some embodiments, a cooking operation initiated by the controller 110 may thus include detecting one or more temperatures of TS1 176A and TS2 176B, and directing heat output from (e.g., a heat setting of) top heating element 152 or bottom heating element 150 based on the detected temperature(s).

Figure 6:
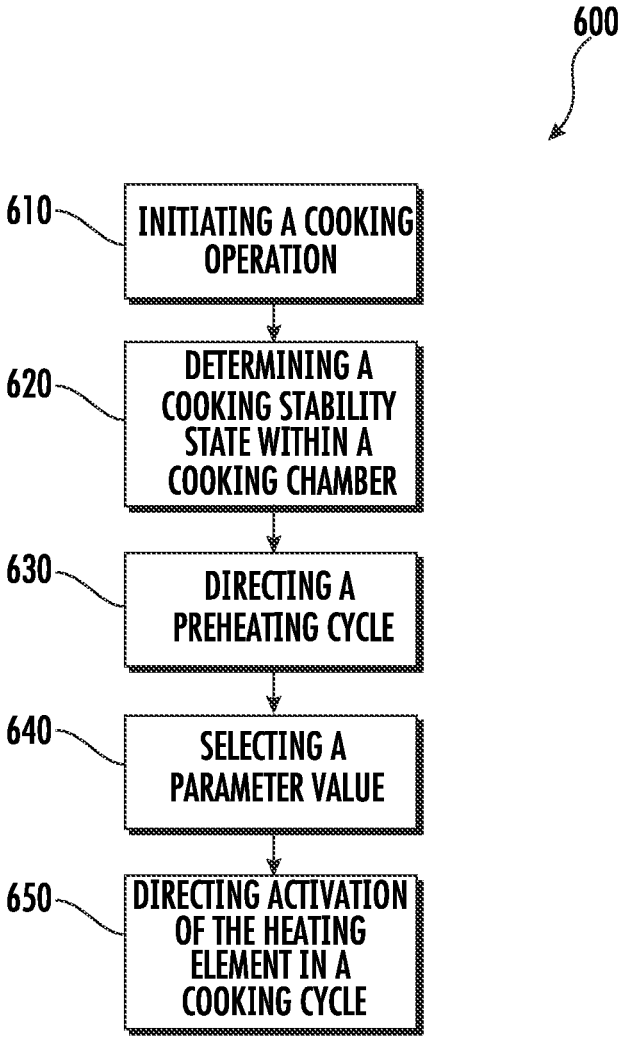
FIG. 6 is a flow chart illustrating of method of operating an oven appliance according to exemplary embodiments of the present disclosure.
Figure 7:
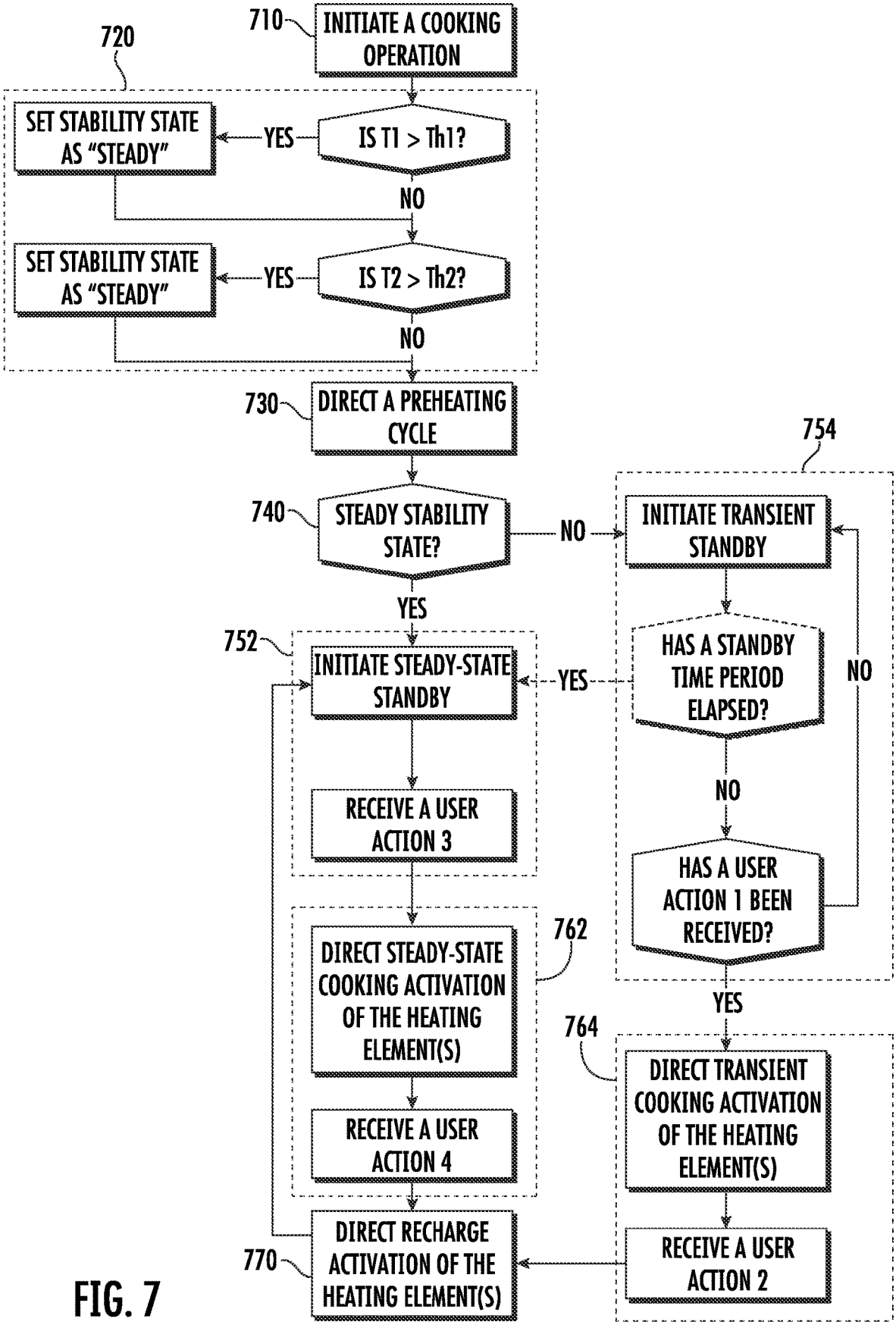
FIG. 7 is a flow chart illustrating of method of operating an oven appliance according to exemplary embodiments of the present disclosure.

Referring now to FIGS. 6 and 7, the present disclosure may further be directed to methods (e.g., method 600 or 700) of operating an oven appliance, such as appliance 100. In exemplary embodiments, the controller 110 may be operable to perform various steps of a method in accordance with the present disclosure.

The methods (e.g., 600 or 700) may occur as, or as part of, a cooking operation (e.g., short-cycle cooking operation) of oven appliance 100. In particular, the methods (e.g., 600 or 700) disclosed herein may advantageously facilitate a cooking plate or surface within a cooking chamber to be brought to a temperature (e.g., selected by a user) consistently or accurately. Additionally or alternatively, the methods (e.g., 600 or 700) may advantageously permit multiple cooking cycles to be performed in relatively quick succession (e.g., without requiring deactivation of all heating elements, without requiring significant cooling of the cooking chamber, or while facilitating rapid or even redistribution of heat within the cooking chamber between cooking cycles).

It is noted that the order of steps within methods 600 and 700 are for illustrative purposes. Moreover, neither method 600 nor 700 is mutually exclusive. In other words, methods within the present disclosure may include either or both of methods 600 and 700. Both may be adopted or characterized as being fulfilled in a common operation. Except as otherwise indicated, one or more steps in the below method 600 or 700 may be changed, rearranged, performed in a different order, or otherwise modified without deviating from the scope of the present disclosure.

Turning especially to FIG. 6, at 610, the method 600 includes initiating a cooking operation. In particular, the cooking operation may initiate or begin in response to one or more operation signals. Generally, the operation signal may indicate that a specific cooking operation (e.g., short-cycle or localized, high-heat cooking operation) is planned (e.g., by a user). For instance, the cooking operation signal may correspond to a user input (e.g., at the control panel). Thus, user engagement of a particular button or input at the control panel may transmit the operation signal to the controller.

At 620, the method 600 includes determining a cooking stability state within the cooking chamber. Specifically, the cooking stability state may be determined to be either a steady state or a transient state (e.g., based on one or more detected conditions of the oven appliance). The steady state may be understood as a state typically associated with recent use of the oven appliance, while the transient state may be understood as a less recent use of the oven appliance.

In some embodiments, the cooking stability state corresponds to or is based on the temperature (e.g., within the cooking chamber). Determining the cooking state may include detecting the temperature value at one or more temperature sensors mounted in thermal communication with the cooking chamber (e.g., as described above). Optionally, one or more temperature thresholds for the cooking state may be predetermined or programmed (e.g., within the controller). In some such embodiments, detecting temperature value(s) greater than the threshold(s) may indicate a steady stability state. As an example, an instance of one or both of the upper temperature sensor and the lower temperature sensor detecting a temperature value above a corresponding temperature threshold (e.g., a different or, alternatively, identical temperature threshold for each temperature sensor) may result in a determination of a steady stability state. By contrast, temperature value(s) less than or equal to the temperature threshold(s) may indicate a transient stability state. As an example, an instance of one or both of the upper temperature sensor and the lower temperature sensor detecting a temperature value less than or equal to the corresponding temperature threshold may result in a determination of transient stability state.

At 630, the method 600 includes directing a preheating cycle. Generally, such preheating cycles are known and may direct the cooking chamber to a selected temperature (e.g., as commanded or input by a user). As an example, one or more of the heating elements may be activated (e.g., at a set power or heat output) until one or more preheating conditions are met, such as expiration of a predetermined preheating period or detection of a target temperature at one or more of the temperature sensors.

In some embodiments, initiation of the preheating cycle at 630 follows determination of the stability state at 620. Thus, the stability state may be determined prior to activation of the heating elements or preheating cycle, generally.

At 640, the method 600 includes selecting a parameter value. In particular, one or more parameter values may be selected according to the cooking stability state determined at 620. Generally, the parameter value(s) may each provide a value to control operation of the oven appliance during a cooking cycle (e.g., following the preheating cycle). Such parameter values may, thus, influence or control activation of one or more of the heating elements.

As an example, the parameter value may include a temperature swing range, such as a range of temperatures (e.g., relative to a selected target or user setpoint temperature) between which the cooking chamber may be permitted to fall before activating/deactivating the heating element(s). As an additional or alternative example, the parameter value may include an active interval for the heating elements (e.g., specifying the continuous active time for the bottom or top heating element(s) during a duty cycle of the cooking operation). As another additional or alternative example, the parameter value may include an inactive interval for the heating elements (e.g., specifying the continuous inactive time for the bottom or top heating element(s) during a duty cycle of the cooking operation). As yet another additional or alternative example, the parameter value may include an offset temperature value for modifying the target or setpoint temperature during a cooking cycle (e.g., specifying how much the user target or setpoint temperature should be increased/decreased at the controller to control activation of the heating elements during the cooking operation).

Separate from, or in addition to, influencing or controlling activation of the heating elements, the parameter values may be different depending on the stability state. Thus, a parameter value corresponding to the steady state may be different from a parameter value corresponding to the transient state. As a result, the controller may be provided or programmed with one or more steady-state parameter values and one or more transient parameter values. As an example, the steady-state active interval may be less than the transient active interval. As an additional or alternative example, the steady-state inactive interval may be greater than the transient inactive interval. As another additional or alternative example, the steady-state offset temperature value may be less than the transient offset temperature value.

The parameter values may be predetermined (e.g., fixed or constant) values or, alternatively, variable values. In turn, 640 may include selecting a steady-state parameter value (e.g., as a predetermined or, alternatively, variable steady-state value), such as when a steady stability state is determined at 620. Similarly, 640 may include selecting a transient parameter value (e.g., as a predetermined or variable transient value).

In the case of variable values, such parameter values may be contingent on, for instance, a detected temperature or time.

As an example, a steady-state parameter value (e.g., temperature swing range, active interval for a heating element, inactive interval for a heating element, offset temperature value, etc.) may be based on the determined cooking stability state (e.g., temperature value detected at one or more of the above-described temperature sensors) at 620 prior to 630. In particular, the detected temperature value from 620 may be used to select the variable value, such as by a using a predetermined look-up table, chart, or formula correlating a known input variable of the detected temperature value with an output of the steady-state parameter value. In some such examples, the steady-state parameter values are proportional to the difference between the detected temperature value and the temperature threshold. Thus, the steady-state parameter value may be a function of a difference value (e.g., the temperature threshold minus the detected temperature value at 620). Additionally or alternatively, a detected time period (e.g., period of elapsed time) since a set trigger instance or action (e.g., the start or initiation of the preheat cycle) may be used to select the variable value, such as by using a predetermined look-up table, chart, or formula correlating a known input variable of the detected time period with an output of the steady-state parameter value.

As another example, a transient parameter value (e.g., temperature swing range, active interval for a heating element, inactive interval for a heating element, offset temperature value, etc.) may be based on the determined cooking stability state (e.g., temperature value detected at one or more of the above-described temperature sensors) at 620 prior to 630. In particular, the detected temperature value from 620 may be used to select the variable value, such as by a using a predetermined look-up table, chart, or formula correlating a known input variable of the detected temperature value with an output of the transient parameter value. In some such examples, the transient parameter values are proportional to the difference between the detected temperature value and the temperature threshold. Thus, the transient parameter value may be a function of a difference value (e.g., the temperature threshold minus the detected temperature value at 620). Additionally or alternatively, a detected time period (e.g., period of elapsed time) since a set trigger instance or action (e.g., the most-recent prior cooking cycle) may be used to select the variable value, such as by using a predetermined look-up table, chart, or formula correlating a known input variable of the detected time period with an output of the transient parameter value.

At 650, the method 600 includes directing activation of one or more heating elements in a cooking cycle. Specifically, activation of the heating elements, or the cooking cycle generally, may be directed according the selected parameter value(s). Thus, the selected parameter value(s) (e.g., for the temperature swing range, active interval for a heating element, inactive interval for a heating element, offset temperature value, etc.) may be used to determine when or how the heating element(s) are activated, as would be understood in light of the present disclosure.

Turning especially to FIG. 7, at 710, the method 700 includes initiating a cooking operation. In particular, the cooking operation may initiate or begin in response to one or more operation signals. Generally, the operation signal may indicate that a specific cooking operation (e.g., short-cycle or localized, high-heat cooking operation) is planned (e.g., by a user). For instance, the cooking operation signal may correspond to a user input (e.g., at the control panel). Thus, user engagement of a particular button or input at the control panel may transmit the operation signal to the controller.

At 720, following 710, the method 700 includes determining a cooking stability state within the cooking chamber. Specifically, the cooking stability state may be determined to be either a steady state or a transient state (e.g., based on one or more detected conditions of the oven appliance). The steady state may be understood as a state typically associated with recent use of the oven appliance, while the transient state may be understood as a less recent use of the oven appliance.

As shown, the cooking stability state may correspond to or be based on the temperature (e.g., within the cooking chamber). Determining the cooking state may include detecting the temperature value at the temperature sensors mounted in thermal communication with the cooking chamber (e.g., as described above). In particular, a temperature T1 may be detected at the lower temperature sensor. A separate temperature T2 may be detected at the upper temperature sensor. A first temperature threshold Th1 may be predetermined or programmed (e.g., within the controller) for the lower temperature sensor. A second temperature threshold Th2 (e.g., distinct from Th1) may be predetermined or programmed (e.g., within the controller) for the upper temperature sensor. Optionally, detecting that either T1 or T2 is above the corresponding temperature threshold Th1 or Th2 may result in a determination of a steady stability state (i.e., "STEADY). By contrast, if both T1 and T2 are less than or equal to the corresponding temperature threshold Th1 or Th2 may result in a determination a transient stability state (e.g., indicated by the absence of a set "STEADY" stability state).

At 730, following 720, the method 700 includes directing a preheating cycle. Generally, such preheating cycles are known and may direct the cooking chamber to a selected temperature (e.g., as commanded or input by a user). As an example, one or more of the heating elements may be activated (e.g., at a set power or heat output) until one or more preheating conditions are met, such as expiration of a predetermined preheating period or detection of a target temperature at one or more of the temperature sensors.

At 740, following 730, the method 700 includes evaluating the stability state. In particular, the method 700 may determine if the stability state is a steady stability or a transient stability state. A steady stability state may prompt the method 700 to 752 while a transient stability state may prompt the method 700 to 754.

Based on determined cooking stability state, 740 may include selecting a parameter value (e.g., in order to proceed to 752 or 754). Generally, the parameter value(s) may each provide a value to control operation of the oven appliance during a cooking cycle (e.g., following the preheating cycle). Such parameter values may, thus, influence or control activation of one or more of the heating elements. As described above, the parameter value(s) may include a temperature swing range, an active interval (e.g., for the bottom or top heating element), an inactive interval (e.g., for the bottom or top heating element), or an offset temperature. Moreover, the parameter value(s) for the steady state (i.e., steady-state parameter values) may be different than the parameter value(s) for the transient state (i.e., transient parameter values). As also described above, the parameter value(s) for one or both of the steady state and the transient state may be predetermined or, alternatively, variable steady-state/transient value(s).

As noted above, in response to a determination of a steady state at 740, the method 700 may proceed to 752. At 752, the method 700 includes initiating or otherwise directing a steady-state standby phase. As would be understood, a steady-state standby phase may generally provide for maintaining the temperature within the oven following the preheat phase (e.g., at the user-selected temperature or a predetermined temperature, such as a standby temperature below the user target or setpoint temperature). The steady-state standby phase may include a scheme or instructions for activating one or more of the heating elements according to the (e.g., steady-state) temperature swing range, active interval, inactive interval, or offset temperature. In some embodiments, the steady-state standby phase continues until a user action ("USER ACTION 3") is taken, such as a user input at the control panel to indicate a user wishes to proceed to the cooking cycle (e.g., at 762)

At 762, following 752, the method 700 includes directing activation of one or more heating elements in a steady-state cooking cycle. Specifically, activation of the heating elements, or the cooking cycle generally, may be directed according the steady-state parameter value(s). Thus, the selected parameter value(s) (e.g., for the temperature swing range, active interval for a heating element, inactive interval for a heating element, offset temperature value, etc.) may be used to determine when or how the heating element(s) are activated, as would be understood in light of the present disclosure. In some embodiments, the steady-state cooking cycle continues until a user action ("USER ACTION 4") is taken, such as a user input at the control panel to indicate a user wishes to proceed to end the cooking cycle (e.g., so that a new cooking cycle for a new food item may be performed).

Separately from 752 and 762, and as noted above, in response to a determination of a transient state at 740, the method 700 may proceed to 754. At 754, the method 700 includes initiating or otherwise directing a transient standby phase. As would be understood, a transient standby phase may generally provide for maintaining the temperature within the oven following the preheat phase (e.g., at the user-selected temperature or a predetermined temperature, such as a standby temperature below the user target or setpoint temperature). The transient standby phase may include a scheme or instructions for activating one or more of the heating elements according to the (e.g., transient) temperature swing range, active interval, inactive interval, or offset temperature. In some embodiments, the transient standby phase continues until a user action ("USER ACTION 1") is taken, such as a user input at the control panel to indicate a user wishes to proceed to the cooking cycle (e.g., at 764).

Optionally, a transient standby time period may be set or programmed (e.g., within the controller). In particular, the transient standby time period may establish a maximum time period (e.g., in minutes) for the transient standby phase in the event that USER ACTION 1 is never received. In response to expiration of the transient standby time period, the method 700 may proceed directly to 752 (e.g., without proceeding to 764).

At 764, following 754 or receipt of the USER ACTION 1, the method 700 includes directing activation of one or more heating elements in a transient cooking cycle. Specifically, activation of the heating elements, or the cooking cycle generally, may be directed according the transient parameter value(s). Thus, the selected parameter value(s) (e.g., for the temperature swing range, active interval for a heating element, inactive interval for a heating element, offset temperature value, etc.) may be used to determine when or how the heating element(s) are activated, as would be understood in light of the present disclosure. In some embodiments, the transient cooking cycle continues until a user action ("USER ACTION 2") is taken, such as a user input at the control panel to indicate a user wishes to proceed to end the cooking cycle (e.g., so that a new cooking cycle for a new food item may be performed).

In the event that cooking operations are not halted (e.g., by the user) or the oven appliance is not otherwise directed to an inactive/non-cooking state, the method 700 may proceed to 770 following 762 or 764 (e.g., in response to receiving USER ACTION 4 or USER ACTION 2). At 770, following the method 700 includes directing recharge activation of the heating element(s) (e.g., top heating element or bottom heating element). As would be understood, recharge activation may direct the cooking chamber to a lower temperature (e.g., according to a restricted or recharge cycle). Thus, heat output at the heating element(s) may be halted or reduced, such as by setting a reduced duty cycle, power output, or temperature threshold for one or more of the heating element(s).

In some embodiments, the 770 can include receiving one or more temperature signals from the temperature sensor during the restriction condition (e.g., during the recharge activation). Optionally, 770 may include directing the heating element(s) according to a recharge threshold. For instance, 770 may include directing the heating element(s) to maintain the oven chamber or a cooking surface at the recharge threshold (e.g., as part of a maintenance cycle directing temperature between an upper recharge threshold and a lower recharge threshold). As would be understood, such actions may be continued or repeated (e.g., according to a feedback loop) during the restriction condition.

Following 770 (e.g., in response to expiration of a predetermined time limit for 770, in response to receiving a discrete user input, or in response to detecting a temperature threshold is reached at one or more of the temperature sensors), the method 700 may return to 752 and certain steps may be repeated, as would be understood in light of the present disclosure.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An oven appliance comprising:

a cabinet;

a plurality of chamber walls mounted within the cabinet, the plurality of chamber walls defining an oven chamber;

a cooking surface defined in the oven chamber;

a heating element mounted in thermal communication with the oven chamber to heat the cooking surface; and a controller in operative communication with the heating element, the controller being configured to initiate a cooking operation comprising determining a cooking stability state within the oven chamber, the cooking stability state being a variable condition that is associated with relative recency of use of the oven appliance, directing a preheating cycle within the oven chamber following determining the cooking stability state, selecting a parameter value according to the cooking stability state, the parameter value being a control value influencing activation of the heating element by the controller, and directing activation of the heating element in a cooking cycle according to the selected parameter value following the preheating cycle.

2. The oven appliance of claim 1, wherein determining the cooking stability state comprises selecting between a steady state associated with relatively more recent use of the oven appliance and a transient state associated with relatively less recent use of the oven appliance, wherein determining the cooking stability state comprises detecting a temperature value above a predetermined threshold, and wherein selecting the parameter value comprises selecting a steady-state parameter value programmed within the controller to correspond to the steady state.

3. The oven appliance of claim 2, wherein the steady-state parameter value is a predetermined steady-state value, the predetermined steady state value being a constant value programmed within the controller.

4. The oven appliance of claim 2, wherein the steady-state parameter value is a variable steady-state value, the variable steady-state value programmed as being contingent on a separate variable value.

5. The oven appliance of claim 4, wherein the variable steady-state value is based on the determined cooking stability state prior to the preheating cycle.

6. The oven appliance of claim 1, wherein determining the cooking stability state comprises selecting between a steady state associated with relatively more recent use of the oven appliance and a transient state associated with relatively less recent use of the oven appliance, wherein determining the cooking stability state comprises detecting a temperature value less than or equal to a predetermined threshold, and wherein selecting the parameter value comprises selecting a transient temperature value programmed within the controller to correspond to the transient state.

7. The oven appliance of claim 6, wherein the transient temperature value is a predetermined transient value the predetermined transient state value being a constant value programmed within the controller.

8. The oven appliance of claim 6, wherein the transient temperature value is a variable transient value, the variable transient value programmed as being contingent on a separate variable value.

9. The oven appliance of claim 8, wherein the variable transient value is based on the determined cooking stability state prior to the preheating cycle.

10. A method of operating an oven appliance comprising a plurality of chamber walls mounted within a cabinet and defining an oven chamber, a heating element mounted in thermal communication with the oven chamber, the method comprising:

determining a cooking stability state within the oven chamber, the cooking stability state being a variable condition that is associated with relative recency of use of the oven appliance;

directing a preheating cycle within the oven chamber following determining the cooking stability state;

selecting a parameter value according to the cooking stability state, the parameter value being a control value influencing activation of the heating element by a controller; and directing activation of the heating element in a cooking cycle according to the selected parameter value following the preheating cycle.

11. The method of claim 10, wherein determining the cooking stability state comprises selecting between a steady state associated with relatively more recent use of the oven appliance and a transient state associated with relatively less recent use of the oven appliance, wherein determining the cooking stability state comprises detecting a temperature value above a predetermined threshold, and wherein selecting the parameter value comprises selecting a steady-state parameter value programmed within the controller to correspond to the steady state.

12. The method of claim 11, wherein the steady-state parameter value is a predetermined steady-state value, the predetermined steady state value being a constant value programmed within the controller.

13. The method of claim 11, wherein the steady-state parameter value is a variable steady-state value, the variable steady-state value programmed as being contingent on a separate variable value.

14. The method of claim 13, wherein the variable steady-state value is based on the determined cooking stability state prior to the preheating cycle.

15. The method of claim 10, wherein determining the cooking stability state comprises selecting between a steady state associated with relatively more recent use of the oven appliance and a transient state associated with relatively less recent use of the oven appliance, wherein determining the cooking stability state comprises detecting a temperature value less than or equal to a predetermined threshold, and wherein selecting the parameter value comprises selecting a transient temperature value programmed within the controller to correspond to the transient state.

16. The method of claim 15, wherein the transient temperature value is a predetermined transient value the predetermined transient state value being a constant value programmed within the controller.

17. The method of claim 15, wherein the transient temperature value is a variable transient value, the variable transient value programmed as being contingent on a separate variable value.

18. The method of claim 17, wherein the variable transient value is based on the determined cooking stability state prior to the preheating cycle.

* * * * *